US007006783B2

(12) United States Patent
Keidel et al.

(10) Patent No.: US 7,006,783 B2
(45) Date of Patent: Feb. 28, 2006

(54) DEVICE AND METHOD FOR FIXING A TONER IMAGE BY SOLVENT VAPOR WHILE REDUCING THE SOLVENT DRAG-OUT

(75) Inventors: Frank Keidel, München (DE); Robert Lang, Allershausen (DE); Gerd Goldmann, München (DE); Peter Segerer, Olching (DE); Günter Rosenstock, Ottobrunn (DE)

(73) Assignee: Oce Printing Systems GmbH, Poing (DE)

( * ) Notice: Subject to any disclaimer, the term of this patent is extended or adjusted under 35 U.S.C. 154(b) by 104 days.

(21) Appl. No.: 10/680,512

(22) Filed: Oct. 7, 2003

(65) Prior Publication Data

US 2004/0126160 A1 Jul. 1, 2004

(30) Foreign Application Priority Data

Oct. 8, 2002 (DE) ..... 102 46 901

(51) Int. Cl.
*G03G 15/20* (2006.01)
*G03G 21/00* (2006.01)

(52) U.S. Cl. ..... 399/340; 399/98

(58) Field of Classification Search ..... 399/98, 399/320, 322, 340; 427/335; 347/156; 430/124
See application file for complete search history.

(56) References Cited

U.S. PATENT DOCUMENTS

| | | | | |
|---|---|---|---|---|
| 3,078,589 | A * | 2/1963 | Carlson | 399/340 X |
| 3,117,847 | A * | 1/1964 | Norton | 399/340 X |
| 3,199,223 | A * | 8/1965 | Carlson | 399/340 X |
| 4,311,723 | A | 1/1982 | Mugrauer | |
| 4,609,279 | A * | 9/1986 | Hausmann et al. | 399/322 |
| 5,016,058 | A * | 5/1991 | Mair | 399/340 X |
| 5,333,042 | A * | 7/1994 | Brennan et al. | 399/320 |
| 5,666,628 | A * | 9/1997 | Fukai | 399/340 |

FOREIGN PATENT DOCUMENTS

| | | |
|---|---|---|
| JP | 58-172669 | * 10/1983 |
| JP | 62-160476 | * 7/1987 |
| WO | WO 02/10862 | 7/2002 |

* cited by examiner

*Primary Examiner*—Sandra L. Brase
(74) *Attorney, Agent, or Firm*—Schiff Hardin LLP

(57) ABSTRACT

In a device and method for fixing toner images on a carrier web, rinsing chambers from which a mixture of solvent vapor and air is drawn off are located before and after a fixing chamber. The mixture is passed through a condenser, the discharge of which is re-supplied to the rinsing chambers.

22 Claims, 11 Drawing Sheets

DEVICE AND METHOD FOR FIXING A TONER IMAGE BY SOLVENT VAPOR WHILE REDUCING THE SOLVENT DRAG-OUT

BACKGROUND OF THE INVENTION

The invention relates to a device for fixing a toner image on a carrier web, comprising a fixing chamber in which toner images present on the carrier web are charged with solvent vapor, the carrier web being supplied to and carried away from the fixing chamber via a respective gap. Further, the invention relates to a method for fixing toner images.

Aside from the fixing of toner images by a contacting heat-pressure treatment and a contactless heat treatment, contactless cold fixing has also gained importance. During this cold fixing, the toner material is softened under the influence of a solvent. The softened toner moistens the surface of the carrier material. When using a carrier material that contains fibers such as, for example, paper or textiles, the softened toner surrounds the fibers and, due to capillary forces, partly penetrates into the spaces between the fibers and into them. After the drying of the carrier material and the evaporation of the solvent, the toner again congeals and solidifies. In this way, the toner is joined to the carrier material in a smear-proof and abrasion-resistant manner.

The presence of the solvent in vapor form is advantageous since a condensation of the solvent vapor onto the toner particles takes place so that the vapor molecules directly deposit on these toner particles. Moreover, the output of the evaporation enthalpy in the condensation supports the softening of the toner and increases the speed of the dissolving process. A further advantage of fixing with the assistance of a solvent vapor is the little thermal stress on the carrier material, from where also the name cold fixing comes from. Accordingly, carrier materials can be employed that withstand only a little thermal or mechanical load such as, for example, labels or films. Moreover, the moisture content of the carrier material is not changed so that a waviness arising due to changes in moisture is avoided. Also, cold fixing is largely independent of the thickness of the carrier material so that, for example, papers having different paper thicknesses can be used without a great modification of the fixing process. In this way, a change in the type of paper can also take place with little expense.

WO 02/10862 A1 of the same applicant discloses a device and a method for fixing a toner image on a carrier material by using solvent vapor. A directed stream containing the solvent vapor is generated, the stream being directed to a section of the carrier material with the aid of a nozzle device. The device described and the method are suited both for simplex printing as well as for duplex printing. The patent application mentioned is herewith incorporated by reference into the disclosure of the present application.

Due to the vapor generation, a slight overpressure is generated in the inside of the fixing chamber, this overpressure having the consequence that the solvent vapor exits the fixing chamber, in particular at the relatively large gaps for the entrance and the exit of the carrier web. These gaps are inevitably present. In the case when the carrier web is printed on both sides and is linearly guided through the fixing chamber, the gap width cannot be designed too narrow. At the surface of the entering carrier web, i.e. at the upper and lower boundary layer, ambient air is captured from outside and brought into the fixing chamber at the entrance gap by means of viscous friction. Due to the constant volume in the fixing chamber, this has the consequence that a corresponding volume, which is enriched with solvent vapor, is forced outwardly from the inside of the fixing chamber at the exit gap. Furthermore, solvent that has reached into the boundary layer at the carrier web in the fixing chamber is dragged out from the fixing chamber at the exit gap together with the carrier web.

For environmental reasons as well as for economic reasons, the escape of solvent from the fixing chamber into the environment, so-called leakages, have to be largely avoided. This means that the leakage streams have to be reduced or the solvent concentration of leakage streams that cannot be avoided has to be kept at a value as low as possible. This requirement is particularly difficult to meet at the entrance gap and the exit gap for the carrier web. A contacting or dragging seal, for example by means of a sealing lip or a sealing roller, is not possible at these points. At the entrance gap, the powder toner merely lies loosely on the carrier web and would be smeared by a dragging seal. A contacting, synchronously running sealing roller by which no toner is removed can only be realized at a high economic expense. At the exit gap, the toner is indeed smear-proof to a certain extent after fixing, but still relatively soft. A dragging sealing lip might result in a toner removal. As shown by experiments, a contacting, rotating sealing roller is quickly covered with toner material if, as is common, it is charged with a high solvent concentration on the side facing the fixing chamber.

The amount of solvent dragged out at the carrier web entrance and at the carrier web exit has to be compensated for in order to maintain the high solvent concentration required for the fixing inside the fixing chamber. In general, this leads to a considerable solvent consumption which in turn causes high operating expenses. In addition, the dragged-out solvent can have a negative impact on the ambient air. In order to be able to keep the admissible work place concentrations for solvents, the fresh air content in the room air has to be very high, which again causes high operating expenses.

FIGS. 1 and 2 show known examples of the prior art. FIG. 1 schematically illustrates the principle of cold fixing. A carrier web 10, in general a paper web, is provided with toner images 14 on both sides in a transfer printing station 12 indicated by a roller pair. Via an entrance gap 16, the carrier web 10 enters a fixing chamber 18, in which a solvent vapor having a high solvent concentration is present.

In the fixing chamber 18 suitable solvents, such as isopropanol, acetone or ethylacetate, are evaporated and the solvent vapor is directed to the upper side and the lower side of the carrier web 10. There, the powdered toner present on the surface is softened by the solvent vapor and is bound on the carrier web. Further details with regard thereto can be taken from WO 02/10862 A1 of the same applicant, the content of which is herewith incorporated by reference into the disclosure of the present application.

The carrier web 10 exits the fixing chamber 18 via an exit gap 20. A roller pair 22 guides the carrier web 10 and generates the web tension required for the contactless fixing. As a result of the vapor generation, a slight overpressure arises in the fixing chamber 18, this overpressure having the effect that solvent is dragged out via the entrance gap 16 and the exit gap 20.

FIG. 2 shows an example according to the prior art as described in U.S. Pat. No. 4,311,723 of the same applicant. This document, too, is incorporated by reference into the disclosure of the present application. In the following, same parts have the same reference signs.

The fixing chamber 18 is designed as a vertically oriented container in which solvent is conducted into the inside of the fixing chamber 18 with the aid of a pump 24. The solvent is evaporated on the bottom which is designed as a heating plate 26. Cooling tubes 28 for cooling the solvent vapor are arranged within the fixing chamber 18. Accordingly, the solvent concentration in the upper region 30 of the fixing chamber is lower than in the middle region 32 and lower than in the lower region 34. Thus, the highest solvent concentration is present in this bottom region 34. The carrier web 10 horizontally enters the fixing chamber 18 and is deflected vertically downwardly at a first deflection unit 36 and is guided into the area with a high solvent concentration in the bottom region 34. The toner images are partly fixed during this path of the carrier web 10. The carrier web 10 is again deflected at a second deflection unit 38 and is finally led out of the fixing chamber 18 again via a third deflection unit 40.

By means of the vertical web guidance, the exit of solvent along the arrows P1, P2 is reduced since the solvent concentration is the highest in the bottom region 34. This reduction in solvent concentration in the upper region is assisted by the cooling tubes 28 which form a cold trap in the upper region 30 of the fixing chamber 18. Thus, the solvent concentration in the region of the entrance and the exit of the carrier web 10 is further reduced. With this arrangement, however, the boundary layer at the surface of the carrier web 10 is not reached by the cooling so that the solvent concentration is not reduced thereat, which results in a considerable solvent drag-out in the case of a relatively high transport speed of the carrier web 10. Further, with this arrangement, a deflection-free, horizontal web guidance as would be required for toner images present on both sides of the carrier web 10 is not possible.

The previous solutions for the problems described are deficient. The entrance gap and the exit gap cannot be designed arbitrarily narrow, since the passing carrier web, such as paper, presents some forms of unevenness such as waviness over the paper width and can swing or flutter. In case of a contact with the gap edges, an abrasion or a smearing of the toner on the carrier web can be caused.

SUMMARY OF THE INVENTION

An object of the invention is to provide a device and a method for fixing toner images with the aid of solvent vapor wherein the solvent drag-out is reduced.

In a device for fixing toner images on a carrier web, the fixing chamber is provided in which a toner image is present on the carrier web or charged with the solvent vapor. Respective gaps are provided via which the carrier web is supplied to and carried away from the fixing chamber. A rinsing chamber is provided exterior to the fixing chamber and located before at least one gap. In the rinsing chamber, solvent vapor exiting from the gap is mixed with air and the mixture is drawn off. At least a portion of the drawn-off mixture is fed to a condenser that condenses and separates at least one solvent. Air exiting the condenser is re-supplied to the rinsing chamber.

In a method for fixing toner images on a carrier web, the carrier is supplied to and carried away from a fixing chamber via respective gaps. The fixing chamber charges the toner images present on the carrier web with a solvent vapor. In front of at least one gap, a rinsing chamber is arranged in which solvent vapor exiting from the gap is mixed with air and the mixture is drawn off. At least a portion of the drawn off mixture is fed to a condenser which condenses and separates solvents. Air exiting the condenser is resupplied to the rinsing chamber.

DESCRIPTION OF THE PREFERRED EMBODIMENT

Figure 1:
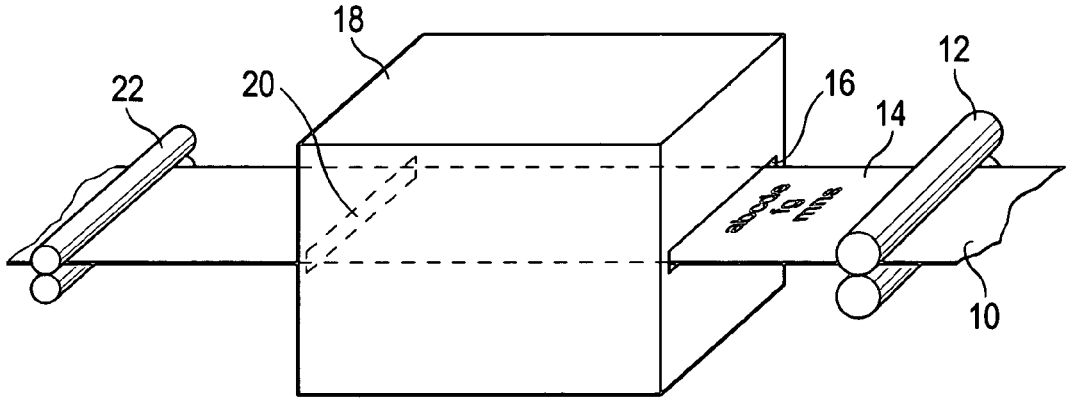
FIG. 1 (PRIOR ART)
FIG. 1 schematically shows the principle of cold fixing according to the prior art.
Figure 2:
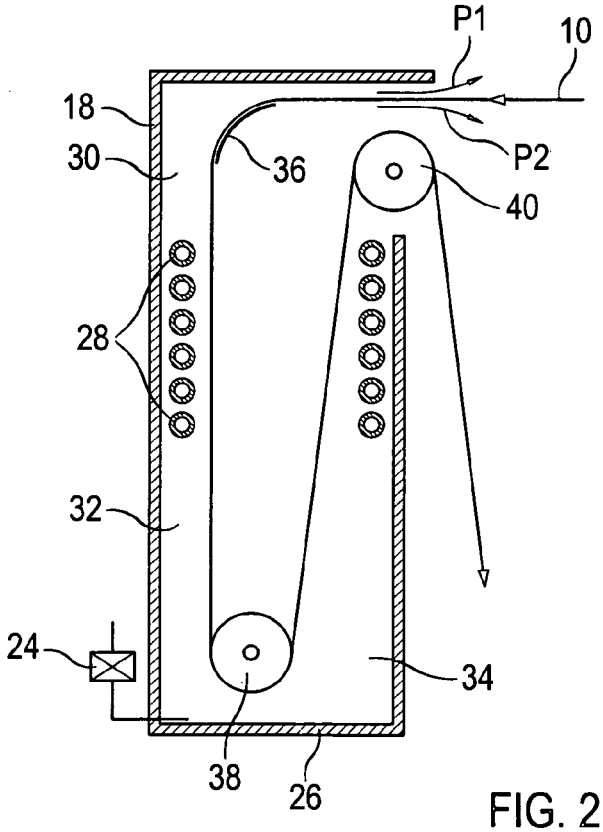
FIG. 2 (PRIOR ART)
FIG. 2 is an example according to the prior art with a vertically oriented fixing chamber.

For a better understanding, reference is made in the following to the preferred embodiments shown in the drawings, which embodiments are described on the basis of specific terminology. However, it is pointed out that the scope of the invention is not to be restricted thereby since such variations and further modifications to the devices shown and/or to the method as well as such further applications of the invention as shown therein are considered as being common present or future knowledge of the relevant person skilled in the art.

A rinsing chamber is arranged in front of one of the gaps, i.e. the entrance gap and/or the exit gap, in which rinsing chamber solvent vapor exiting from the gap is mixed with air and the mixture is drawn off. At least part of this drawn-off mixture is supplied to a condenser which condenses and separates solvents. The air exiting the condenser is re-supplied to the rinsing chamber. In this way, a circuit of rinsing air having a considerably reduced solvent content is created and the carrier web in the rinsing chamber is charged with this rinsing air. The leakage streams that might exit the rinsing chamber have a considerably reduced solvent concentration compared to the leakage stream from the fixing chamber so that the solvent drag-out is substantially reduced in the entire device. This leads to advantages with respect to the impact on the environment and the operating expenses.

According to a further aspect, a method is specified. The advantages achieved by this method substantially correspond to those of the disclosed device.

Figure 3:
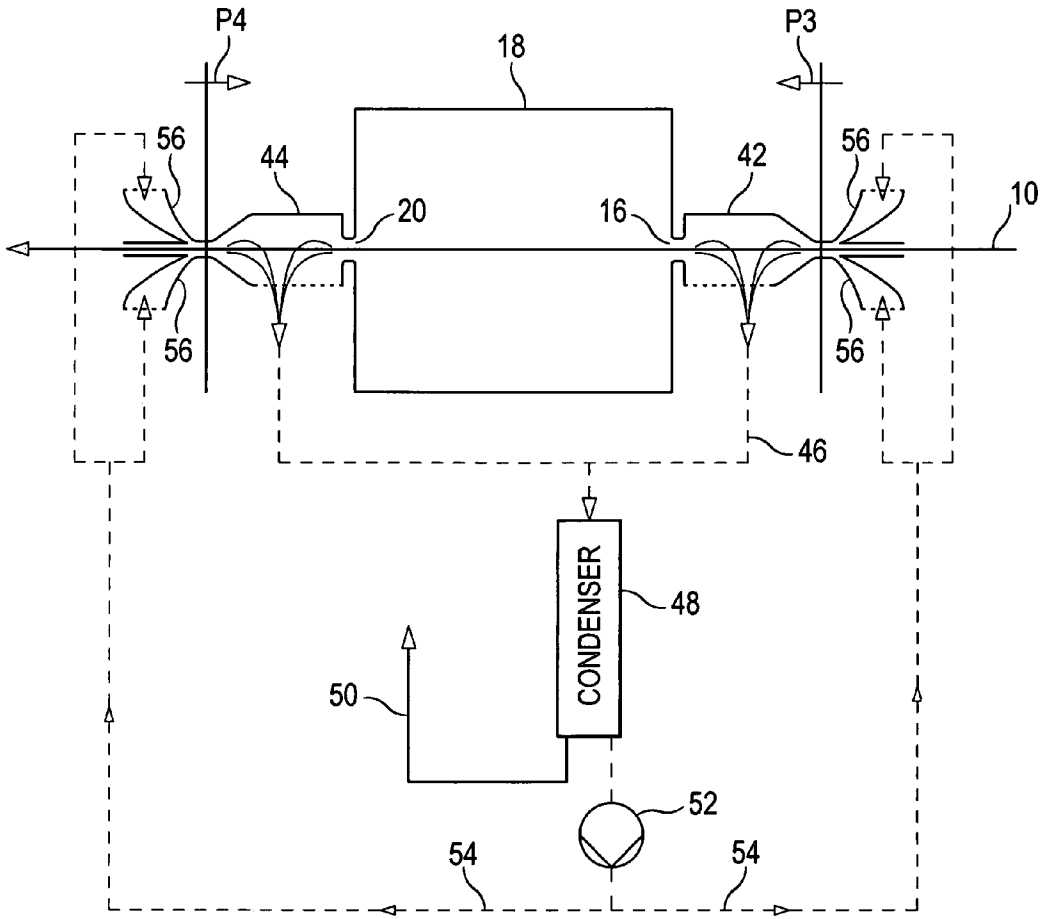
FIG. 3 schematically shows the principle of the preferred embodiment described herein.

FIG. 3 schematically shows the principle realized in a preferred embodiment. As mentioned, same parts still have the same reference signs. Before the entrance gap 16 and after the exit gap 20, rinsing chambers 42 or 44 are located. From these rinsing chambers 42 and 44 an air mixture 46 is drawn off which contains solvent vapor exiting from the gap 16 or 20. The drawn-off mixture 46 is supplied to a condenser 48 that condenses solvent and separates it as condensate 50. The condenser 48 is equipped with a cooling unit that dries the mixture 46, which is re-supplied to the rinsing chambers 42 and 44 in the form of an air circuit with the aid of a fan 52. The supply of the dried air is carried out such that the direction of flow in the respective rinsing chamber 42 and 44 is directed toward the gap 16 or 20. In this way, a dynamic vapor barrier without mechanical contact is created, which barrier prevents an exit of solvent vapor from the entire device. The vapor barrier is indicated by arrows P3 and P4.

The supply of the dried air 54 is effected via nozzles 56 in order to prevent the exit of leakage streams. In the arrangement of FIG. 3, the carrier web 10 can be provided with toner images on the upper side and on the lower side. Accordingly, the units are designed approximately symmetrical on both sides of the carrier web 10. When toner is only applied to one side of the carrier web 10 (simplex printing), the corresponding units on the other side, to which no toner is applied, can be omitted.

In an alternative, only one rinsing chamber 42 or 44 can also be employed, an advantage already resulting with respect to a reduction of the solvent drag-out. The condensate 50 separated by the condenser 48 can again be supplied to the solvent circuit, as will be explained in more detail below.

Figure 4:
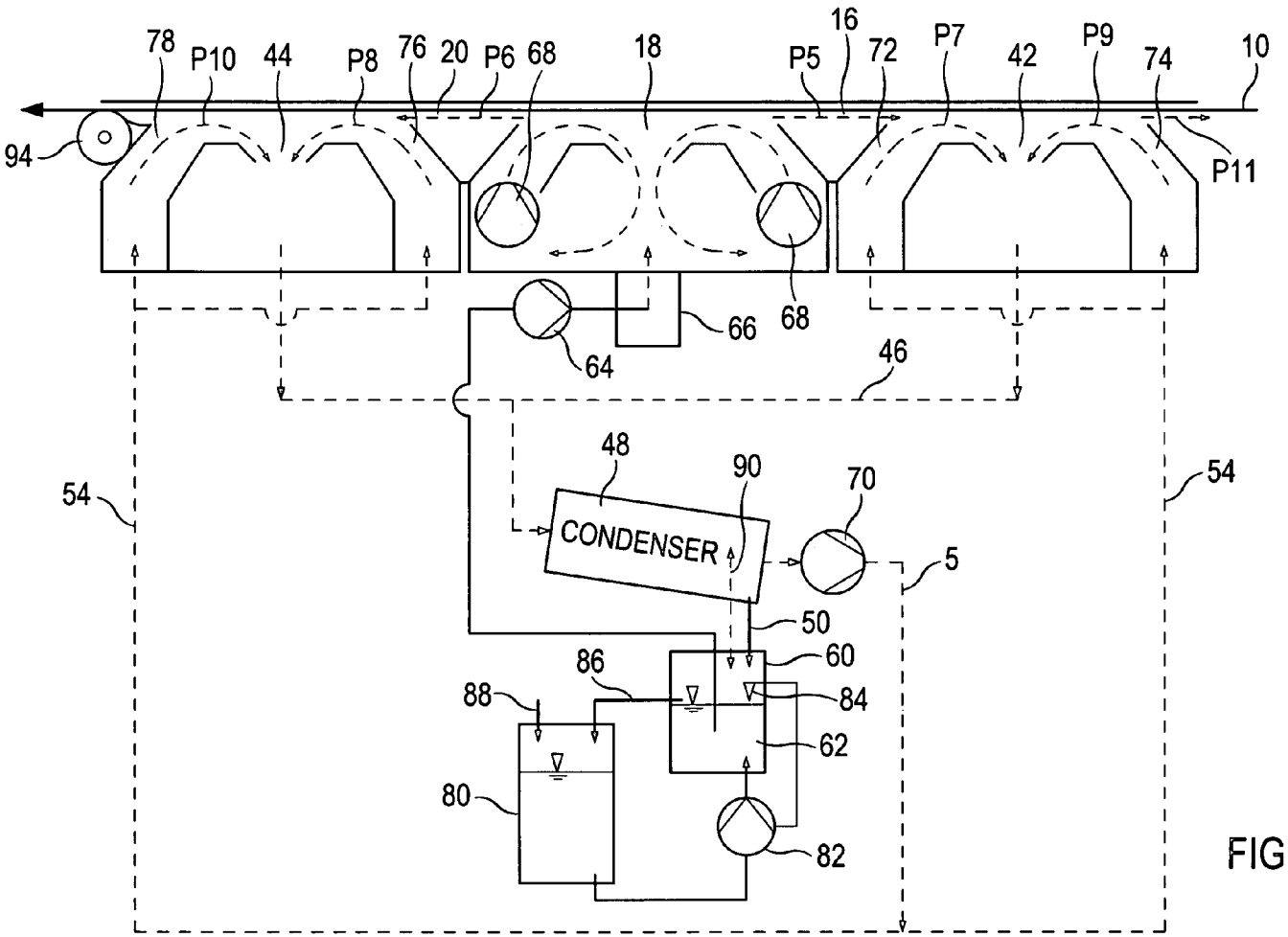
FIG. 4 shows details of the preferred embodiment.

FIG. 4 shows a more detailed example, in which for reasons of simplification only toner images on the lower side of the carrier web 10 are fixed. For a fixing on both sides, then the units of the type of FIG. 3 have to be added for the other fixing side. Liquid solvent 62 is pumped to an evaporator 66 arranged at the fixing chamber 18 with the aid of a pump 64 from a buffer container 60. The solvent 62 is evaporated and is supplied to the fixing chamber 18 in vapor form. The solvent vapor is circulated with the aid of fans 68, solvent vapor being blown turbulently at the carrier web 10 transported through the fixing chamber 18.

Located following the fixing chamber 18 in which a high solvent concentration is present are the rinsing chambers 42 and 44, in which the solvent vapor exiting from the fixing chamber is drawn off as an air mixture 46 and is re-supplied later on as dried air 54. The solvent vapor exiting from the fixing chamber 18 (indicated by the arrows P5 and P6) is caught in the rinsing chambers 42 and 44 by the dried air streams 54 as a directed stream P7 or P8. These air streams P7 and P8 are directed toward the middle of the respective rinsing chamber 42 and 44 and toward the carrier web 10. The other partial stream of the dried air 54 runs in the direction of the air streams P9 and P10 and is likewise directed toward the middle of the rinsing chambers 42 and 44 and blows at the surface of the carrier web 10. In the middle of the rinsing chamber 42 and 44 a middle stream forms by the opposite streams P7 and P9 and P8 and P10 that is drawn off as an air mixture 46. The movement of the air in the circuit of drawn-off air 46 and re-supplied air 54 is generated by a fan 70.

Due to the cooler acting in the condenser 48, a solvent is condensed from the drawn-off air stream 46. The condensate 50 is collected in the buffer container 60. From there, it returns into the fixing chamber 18 via the evaporator 66, as a result whereof a solvent circuit is created.

The recovery of the solvent is designed as an open system which substantially operates at ambient pressure. Thus, by increasing the pressure in the condenser 48, the temperature of the dew point cannot be raised. The cooling to the freezing point at ambient pressure, for example for acetone at −95° C., required for a complete separation of the solvent, is so complicated technically that a low remaining solvent content cannot be avoided. Therefore, a certain solvent concentration remains in the dried air 54. This solvent concentration corresponds to the saturation concentration at prevailing ambient pressure and prevailing condenser temperature.

The condenser exhaust air or dried air 54 is not blown into the surrounding area but is cleverly supplied to the rinsing chambers 42 and 44 via nozzles 72 and 74 in the rinsing chamber 42 and nozzles 76 and 78 in the rinsing chamber 44. The nozzles 72, 74 and 76 and 78 are arranged symmetrically to one another and are directed toward the center of the respective rinsing chamber 42 and 44. Thus, rinsing streams P7 and P9 and P8, P10 result which are directed symmetrically to the center of the rinsing chambers 42 and 44. By way of this stream guidance it is avoided that solvent vapor is blown out of the rinsing chambers 42 and 44 into the surrounding area and ambient air is dragged in from the outside into the fixing chamber 18. Thus, there results an outward neutrality. A dilution of the solvent concentration in the fixing chamber 18 is thus avoided, which might deteriorate the fixing quality. The rinsing streams P7 and P9 and P8 and P10 strike the surface of the carrier web 10 in the rinsing chambers 42 or 44 preferably under an angle of about 30 to 60° as a turbulent flow.

The air streams circulating through the rinsing chambers 42 and 44 and the condenser 48 form a rinsing air circuit. In operation, the saturation concentration for the solvent at prevailing ambient pressure and the prevailing condenser temperature substantially arises in the rinsing air circuit. Solvent vapor exiting from the fixing chamber 18 then leads to an exceeding of the saturation concentration, and by means of the condenser 48 excessive solvent is condensed and resupplied to the solvent circuit.

A solvent drag-out cannot be fully avoided. Accordingly, the filling level of solvent 62 in the buffer container 60 constantly decreases. This solvent loss is compensated for from a supply container 80 with the aid of a pump 82. For controlling the filling level in the buffer container 60, a filling level sensor 84 can be used which deactivates the pump 82 when a desired level is reached. Instead of a level-controlled pump, a continuously running pump having an overflow 86 can also be used. The pump capacity of this pump then has to correspond to at least the maximum consumption. In order to compensate for changes in volume in the condenser 48, in the buffer container 60 and in the supply container 80 ventings 88 and 90 are provided.

The remaining leakages or escapes in the entire system, which cannot be avoided in principle, result in a drag-in of ambient air in the same amount. With the ambient air, water is dragged into the system according to the absolute moisture of the air. This water is partly eliminated with the solvent in the condenser 48 and contaminates the solvent 62 in the buffer container 60 which is provided for re use. At normal room air conditions, the water content in the buffer container 60 which is dependent on the absolute moisture of the ambient air, levels out at a normal range, for acetone as a solvent for example at about 4 to 5 weight percent. Tests have shown that this value for the softening of the toner in the fixing chamber 18 is still uncritical. In order to avoid functional disorders by means of contamination, filters can be arranged in front of the pump 64 and 82.

Figure 5:
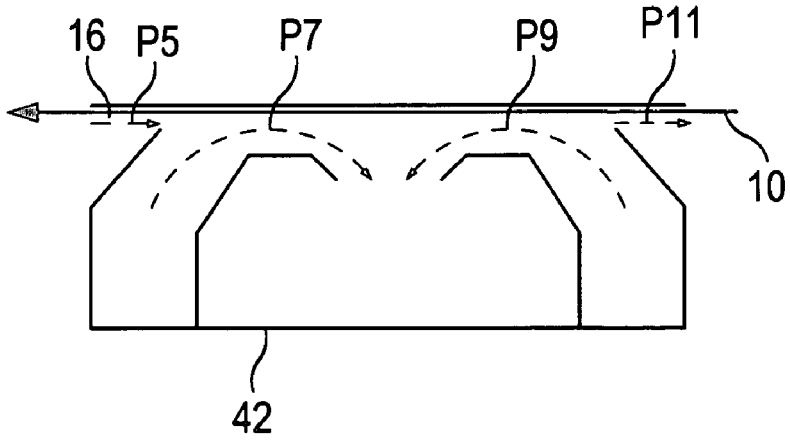
FIG. 5 shows the structure of the rinsing chamber located before the fixing chamber.

FIG. 5 is an illustration of the rinsing chamber 42 that is located before the region of the entrance gap 16. The highly concentrated solvent vapor P5 exiting from the fixing chamber 18 is mixed in by the rinsing stream P7. The stream P9 forms the symmetric counter stream in order to realize an outward neutrality as well as the dynamic vapor barrier. If a leakage stream P11 is present at the entrance gap of the rinsing chamber 42, no highly concentrated solvent vapor exits, but an air solvent vapor mixture with low solvent concentration.

Figure 6:
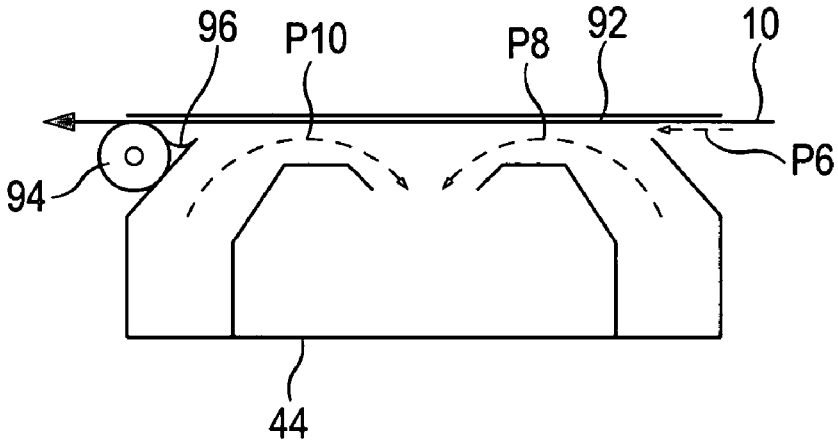
FIG. 6 shows the structure of the rinsing chamber located after the fixing chamber.

FIG. 6 shows details of the rear-rinsing chamber 44. The stream P8 mixes with the highly concentrated solvent vapor stream P6 exiting from the fixing chamber 18. In particular, a laminar boundary layer 92 entrained by the surface of the carrier material 10 and highly enriched with solvent vapor is dissolved. The air streams P8 and P10 dry the surface of the carrier web 10 and thus the toner images. In addition to the dynamic sealing by rinsing and drying, in the embodiment according to FIG. 6 and FIG. 4 the exit of solvent vapor from the exit side of the rinsing chamber 44 is prevented by a sealing roller 94 in connection with a sealing lip 96 adjacent to the sealing roller 44. The contacting of the carrier web 10, for example a paper web, by the sealing roller 94 is possible at this location since, due to the charging with dried air in the rinsing chamber 44, the toner softened during the fixing in the fixing chamber 18 is already partly hardened and on the other hand no dew collects on the sealing roller 94 due to the low solvent concentration in the rinsing air. The sealing roller 94 comprises a toner-repellent material, for example Teflon or PFA material, or should be coated with such a material in order to avoid an adhering of toner. The toner-repellent property of the roller can also be created or improved by the application of silicone oil.

The circumferential speed of the sealing roller 94 has to correspond to the transport speed of the carrier web 10 so that the toner is not smeared due to slip. For this purpose, the sealing roller 94 can either be entrained by contact with the carrier web 10 or can be driven with the aid of a controlled motor. The sealing roller 94 acts as a support in a stabilizing manner for the carrier web 10. A fluttering of the carrier web is reduced so that the gaps in the rinsing chambers 42 and 44 and in the fixing chamber 18 can be set narrower and even less solvent vapor can escape from the fixing chamber 18 into the rinsing chambers 42 and 44 and from them.

In an alternative embodiment the sealing roller 94 and the sealing lip 96 shown in FIGS. 4 and 6 can be omitted. Then, however, an increased solvent drag-out has to be expected. Further, the illustrated horizontal transport direction does not have to be kept and a transport direction under an angle to the horizontal is possible.

Figure 7:
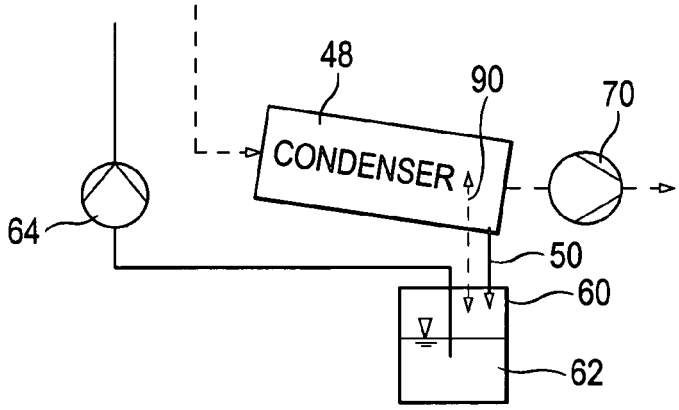
FIG. 7 shows an example with a buffer container for the solvent.

FIG. 7 shows another alternative in which the buffer container 60 also has the function of the supply container. When the buffer container 60 is empty, it is replaced. What is disadvantageous is that with decreasing filling level in the buffer container 60 the water content in the solvent supply 62 increases. A premature replacement of the buffer container 60 can then be required. Such a container replacement can result in a standstill of the printer device.

Figure 8:
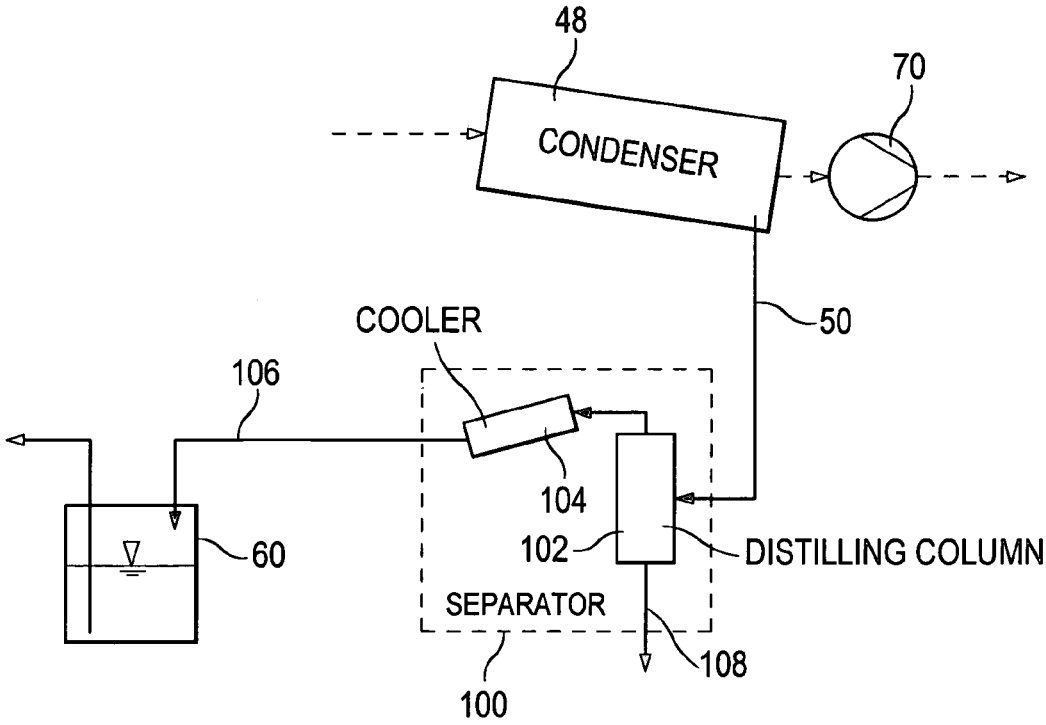
FIG. 8 shows an example with a water separator for the condensed solvent.

In the example according to FIG. 4 and according to FIG. 7, the condensate 50 directly reaches the supply container 80 or the buffer container 60. As a result thereof, water that has been separated with the solvent during condensation enters the solvent supply and thus the solvent circuit. FIG. 8 shows an example by means of which this can be avoided. The condensate 50 separated by the condenser 48 is supplied to a separator 100 in which the solvent is separated from the water. When using a solvent that cannot, or which can only partly be mixed with water, such as ethylacetate, the separator 100 can comprise a water separator. When a solvent is used that can be mixed with water, for example acetone, a distilling apparatus can be employed as a separator. In the example of FIG. 8, the distilling apparatus comprises of a distilling column 102 and a cooler 104. After the separation, the pure solvent 106 can be supplied to the buffer container 60 or alternatively to the supply container 80, while the water 108 can be collected separately.

Figure 9:
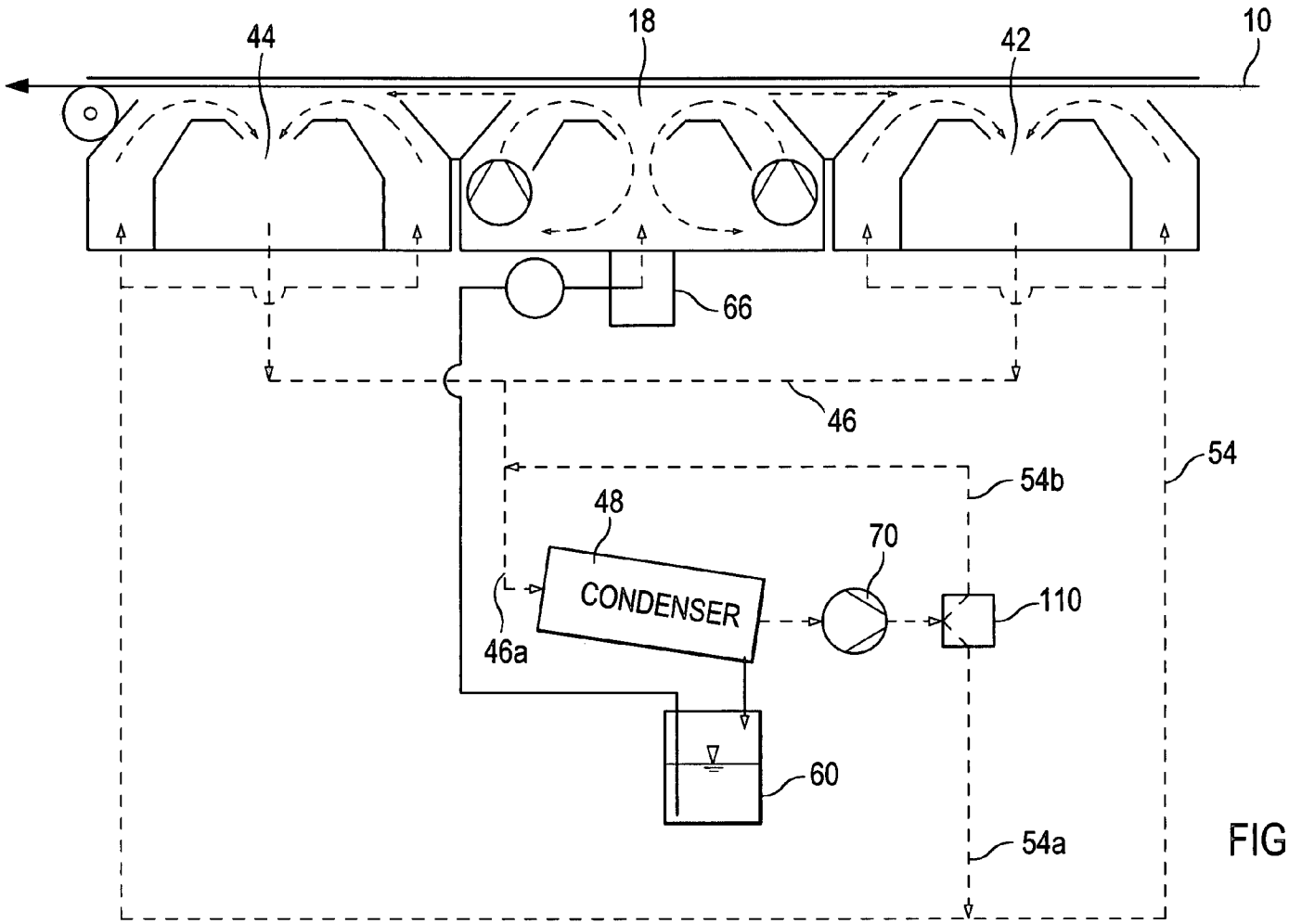
FIG. 9 shows an example with an air stream by-pass.

FIG. 9 shows an embodiment similar to the one in FIG. 4. In contrast thereto, a portion 54*b* of the dried air is re-supplied to the condenser 48 with the aid of a by-pass. A distributor 110 adjusts the ratio of the partial streams 54*a* and 54*b*. In this way, the condenser stream 46*a* can be set to a high value since as a result thereof the heat elimination in the condenser 48 is improved. The rinsing stream 46 or 54 should, on the one hand, as illustrated above, be at least so strong that it is sufficient to dissolve the laminar boundary layer (boundary layer 92 in FIG. 6) comprising highly concentrated solvent vapor, the layer being entrained by the carrier web 10. On the other hand, the stream velocity should not be too high since otherwise the drag-out (stream P11 in FIG. 5) becomes too high due to irregularities in the rinsing stream or a non-optimum flow angle. Moreover, an unnecessary high rinsing stream causes an additional energy expense if it is required to heat the rinsing air in order to avoid condensation above the carrier web 10. The provision of the likewise necessary additional cooling capacity results in increased costs. By the by-pass principle it is also made possible, in case the supply of air to the nozzles is completely deactivated, to use the by-pass air stream 54*b* for pre-cooling the rinsing air circuit or for temperature regulation during a pressure interruption, without causing a leakage loss or a water drag-in into the system. The distributor 110 can be comprised of a distributor flap or can include one to two throttles. The fan 70 illustrated in FIG. 9 can also be located before the condenser 48.

Figure 10:
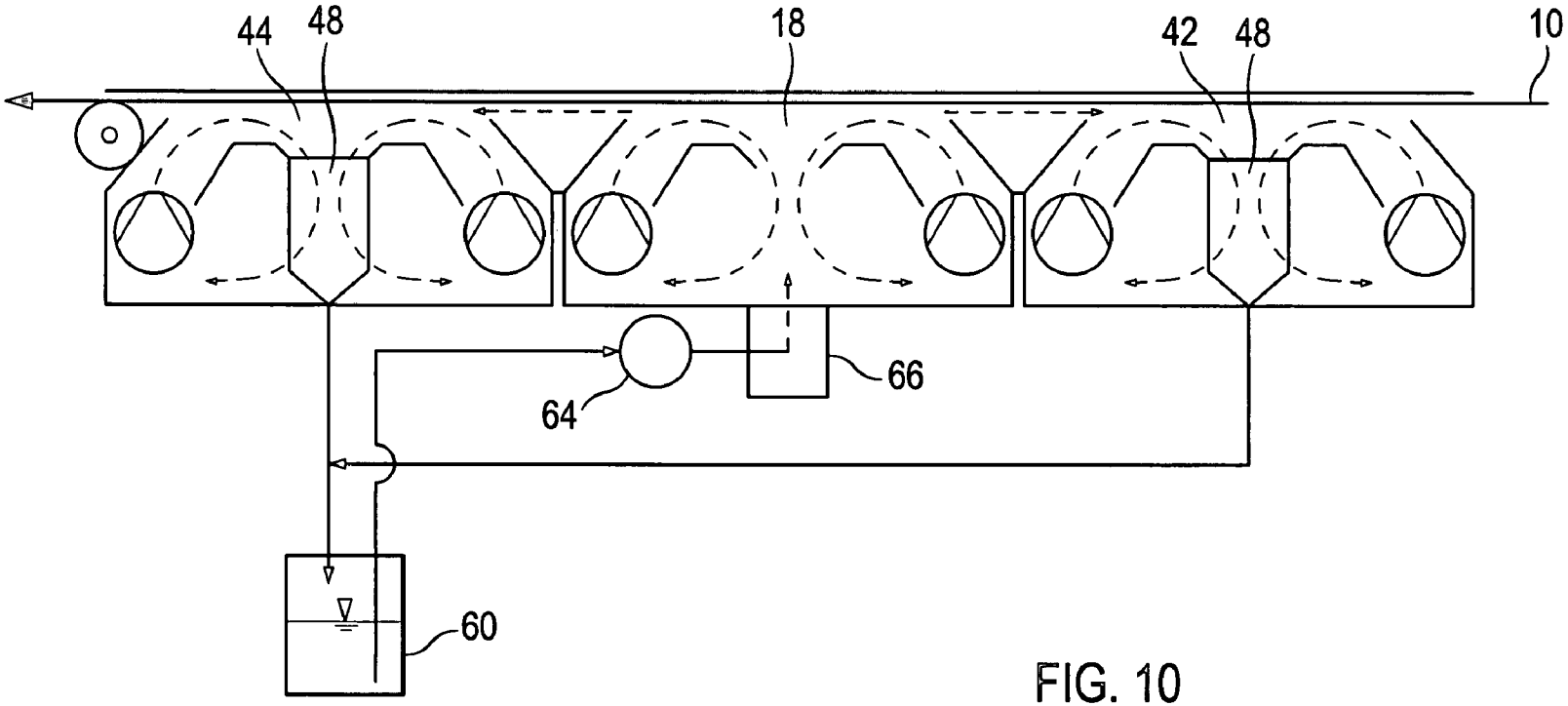
FIG. 10 shows an arrangement with condensers integrated in the rinsing chambers.

In FIGS. 4 and 9, the condenser 48 is arranged outside the rinsing chambers 42 and 44. However, an arrangement as in FIG. 10 can likewise be chosen in which a condenser 48 is enclosed in the respective rinsing chamber 42 and 44. In this alternative the external air shafts and air ducts are omitted. In the rinsing air circuit an explosive air solvent vapor atmosphere can be created depending on the solvent used as well as on the condenser temperature. By omitting the airshafts in the embodiment according to FIG. 10, the explosive volume is reduced.

Figure 12:
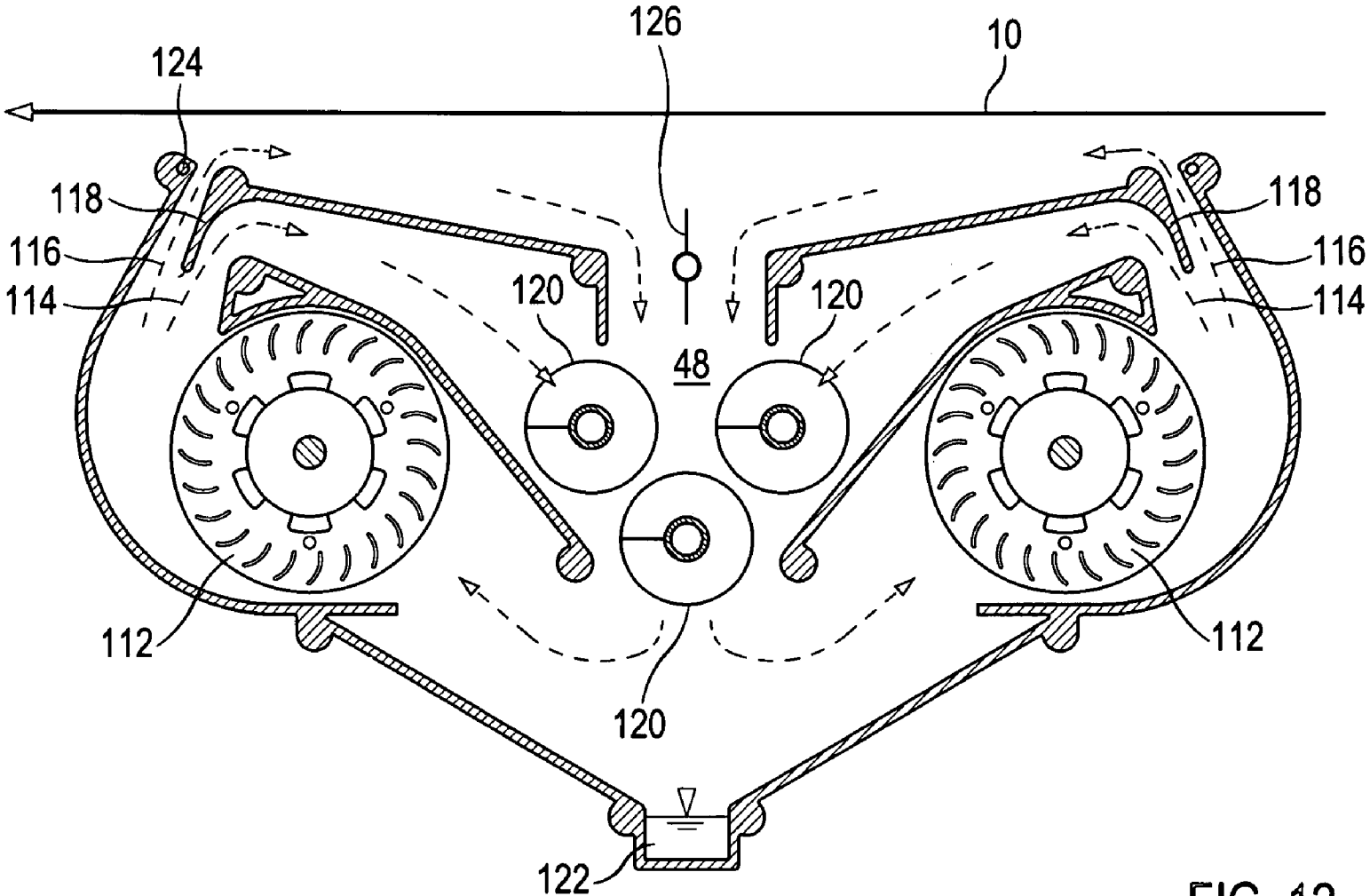
FIG. 12 shows an example with cooling elements arranged in the rinsing chamber and a by-pass air stream.

The by-pass principle can also be employed in the case of a condenser integrated in the rinsing chamber. Such an arrangement is illustrated in FIG. 12. Two roller fans 112 produce air streams 114 and 116 at distribution elements 118. The air streams 116 turbulently blow at the surface of the carrier web 10. The air streams 114 reach cooled tubes 120 which form the condenser 48. The stream enriched with solvent is drawn off in the center and dried at the cooling tubes 120. The dripping condensate is collected in a collecting main 122 and drained off. The bypass stream 114 is directly conducted to the cooling tubes 120 without contact with the carrier web. By the continuous mixing of the streams 114 and 116 there results, statistically, a multiple secondary drying of the rinsing stream, as a result of which the separation efficiency is improved. For a temperature-regulation of the rinsing area in the stand-by mode, flaps 124 and 126 can be provided which, when actuated, prevent a blowing at the carrier web 10 in a closed condition. It is pointed out that such a stream guidance with corresponding flaps 124, 126 can also be employed in the other illustrated embodiments.

Figure 11:
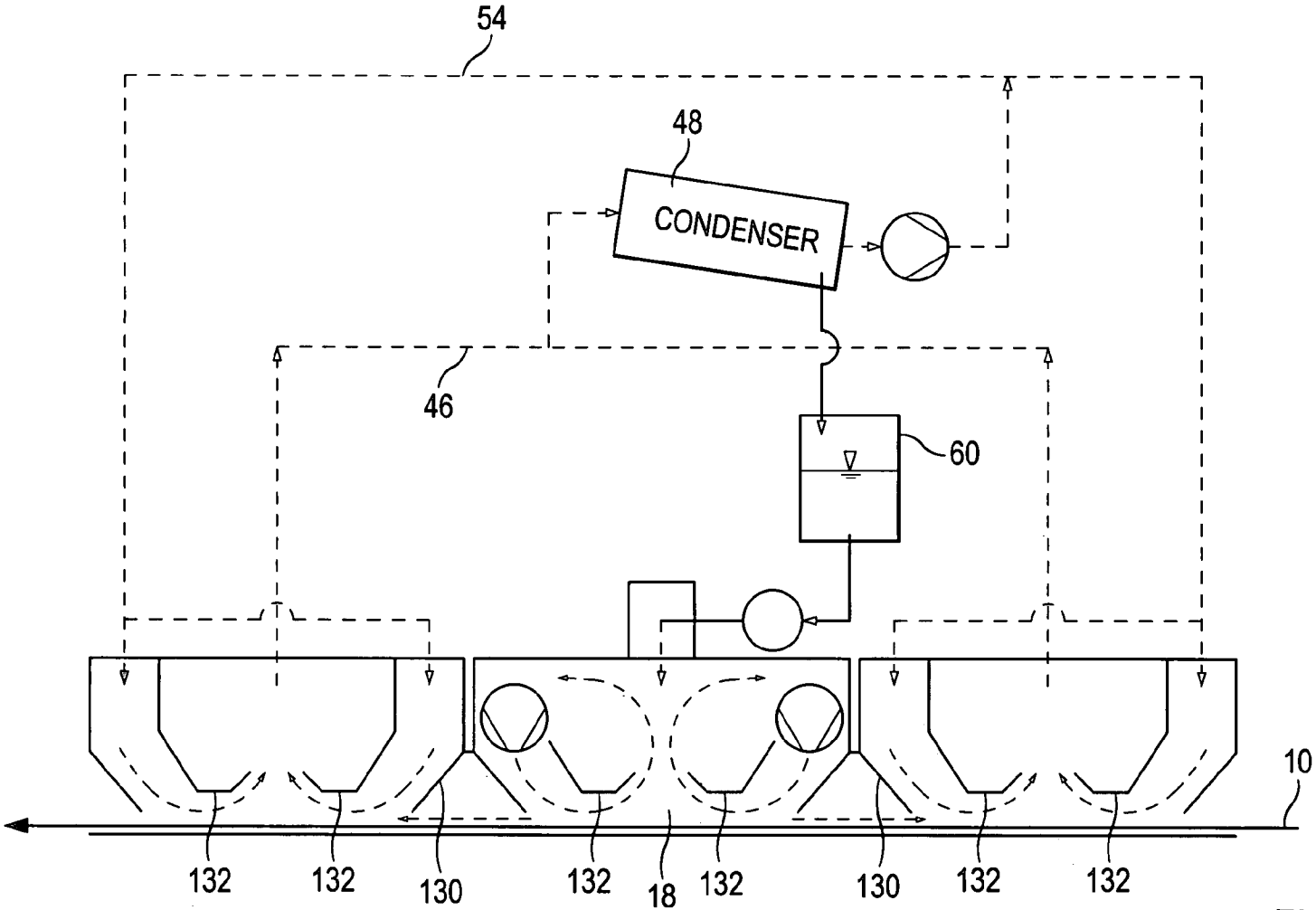
FIG. 11 shows a fixing chamber and two rinsing chambers arranged above the carrier web.

FIG. 11 shows an embodiment in which the units for fixing and rinsing are arranged above the carrier web 10. In this case, care has to be taken with regard to the rinsing chambers 42 and 44 and the fixing chamber 18 that the solvent vapor does not condense on cold housing walls and drops down onto the carrier web 10. It is convenient that in sections, in which solvent might drop down onto the carrier web 10, such as the sections 130, the temperature of respective wall sections is sufficiently high, preferably above the dew point of the mixture in order to avoid a condensation. Preferably, these housing sections should be actively heated. A condensation of solvent vapor should also be avoided in further sections, for example in the areas 132, so that no solvent can collect thereat. There, too, the housing walls and elements are to be heated actively or a good condensate run-off has to be provided. The housing sections mentioned, in particular in the rinsing chambers 42 and 44 can either be heated actively with suitable heating elements or passively by means of contact with warm housing walls of the fixing chamber 18 or by pre-heating the rinsing air.

As illustrated in FIGS. 4, 9, 10 and 12, the fixing chamber 18 and the rinsing chambers 42 and 44 are preferably located below the carrier web 10 so that no solvent drops can reach the upper surface thereof. Regarding the energy consumption, this has two advantages. On the one hand, the housing walls of the rinsing chambers 42 and 44 then do not have to be heated. The energy for heating can thus be saved. On the other hand, it is avoided that energy is transferred from the heated housing walls to the passing rinsing stream, which would result in a heating of the rinsing stream. This energy would then have to be additionally taken from the condenser 48. By avoiding heating at heated housing walls, the condenser 48 and the associated cooler can be designed smaller with respect to capacity and electric power can be saved. A particularly advantageous embodiment comprises the integration of an internal rinsing circuit, i.e. the integration of the condensers 48 into the rinsing chambers 42 and 44 and an arrangement of the fixing chamber 18 and the rinsing chambers 42 and 44 below the carrier web 10. Since the heating of the rinsing streams is avoided, the internal condensers can have a smaller structural size and thus can be integrated more easily.

Figure 13:
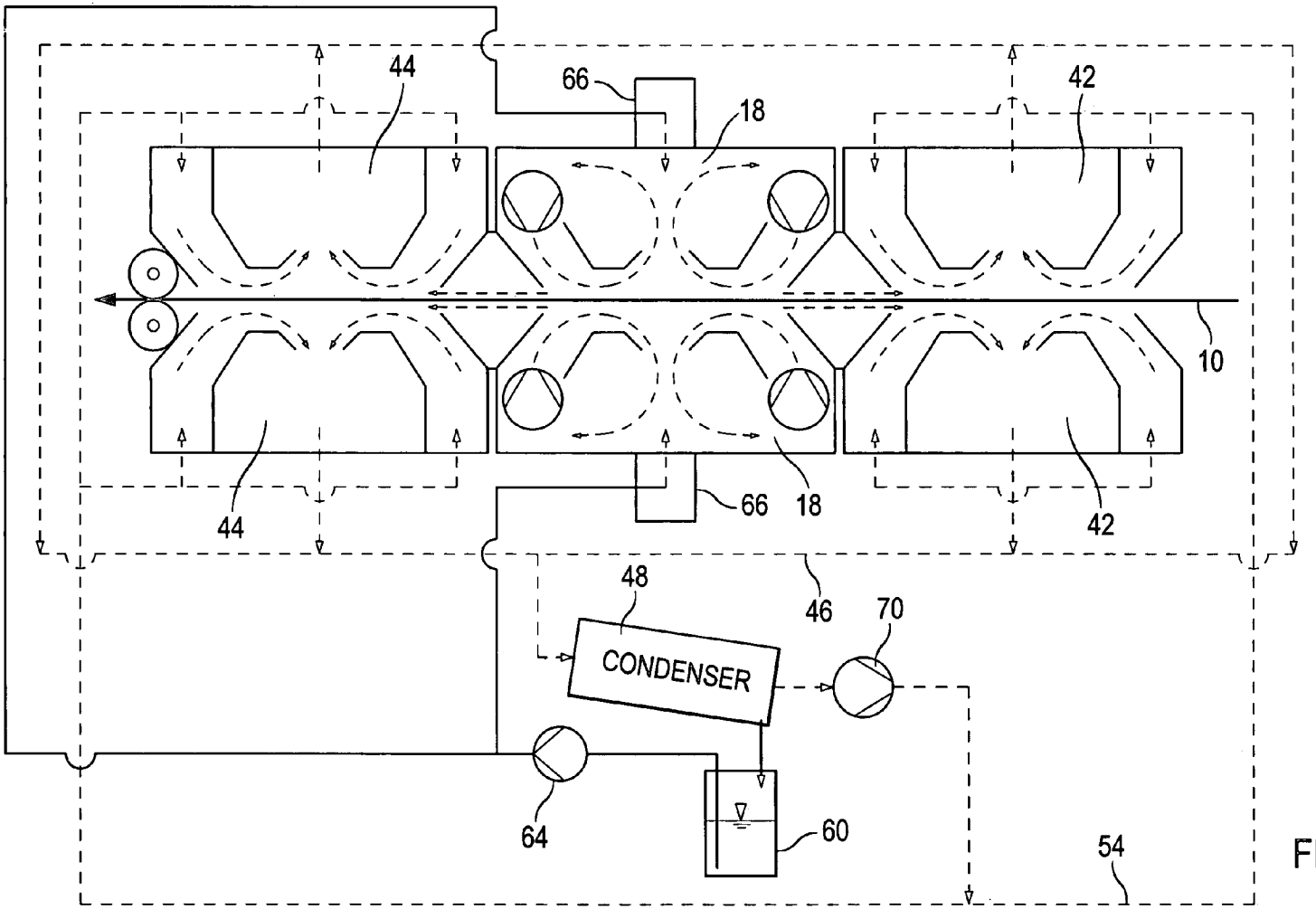
FIG. 13 shows an arrangement for the simultaneous fixing of toner images present on both sides of the carrier web.
Figure 14:
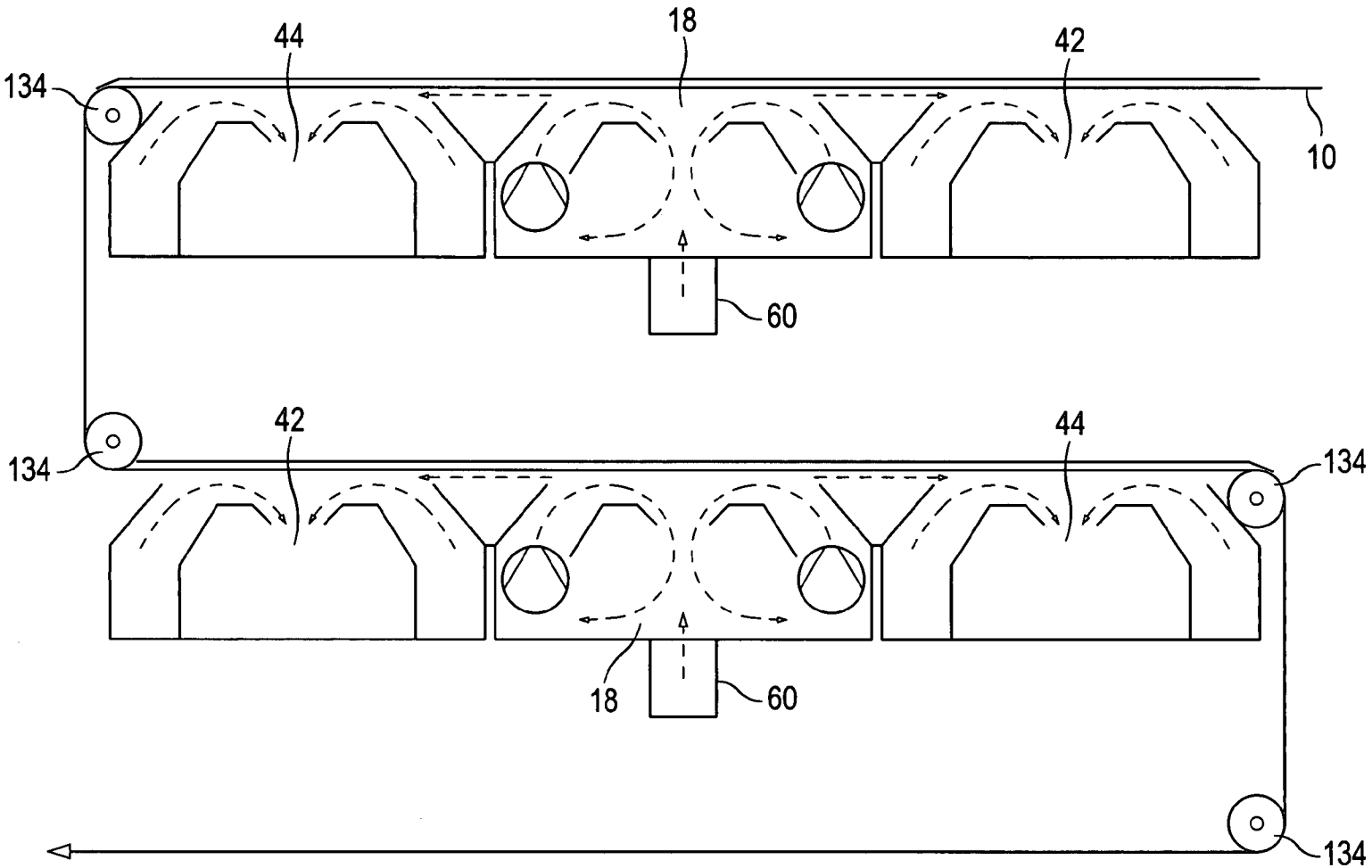
FIG. 14 shows an arrangement in which toner images present on both sides of the carrier web are first fixed on one side and then on the other side.

FIGS. 13 and 14 show embodiments in which toner images can be fixed which are applied to both sides of the carrier web 10. In FIG. 13, the various units for fixing and rinsing are arranged on both sides of the carrier web 10. Two sealing rollers are-arranged at the paper discharge.

FIG. 14 shows an embodiment in which the two sides of the carrier web 10 provided with toner images are fixed one after the other. In this case, the gaps at the discharge points and at the entrance for the second fixing operation can be adjusted very narrow by the arrangement of the rollers 134 due to the exact guidance and thus the avoidance of waviness and fluttering of the carrier web so that the sealing is improved at these locations.

As can be seen with reference to the description and the specific embodiments, a device is provided which, despite the present openings toward the outside, results in a strong reduction of the solvent drag-out from a fixing chamber 18 without damaging the print image on the carrier web. In the device described, the carrier web 10 is not contacted in the following rinsing chamber 44, or only after drying. Thus, the entire fixing process can be effected without contact. In the rinsing chambers 42 and 44, turbulent flow conditions are created at the surface of the carrier web 10, as a result of which a laminar boundary layer entrained by the carrier web 10 at the exit of the fixing chamber 18 and having a high solvent concentration is dissolved. In the following rinsing chamber 44, this effects a drying of both the solvent vapor exiting the fixing chamber 18 as well as the carrier web 10 and the print image. In the rinsing chambers 42 and 44 flow conditions are created such that a drag-in of ambient air into the rinsing chamber or fixing chamber can be avoided and thus no volume exchange between the surrounding area and the rinsing chamber and the fixing chamber takes place. In the following rinsing chamber 44, the process drying and sealing takes place in the correct order, namely such that by the previous drying, no dew collects on the following sealing elements. Thus, a toner deposit at the contacting sealings is avoided; moreover, it is avoided that liquid condensate reaches the carrier web.

By arranging a by-pass in the rinsing air circuit, the volume streams through the condenser or through the rinsing nozzles can each be adjusted optimally independent of one another. Further, it is possible to completely disconnect the rinsing air supplied to the rinsing nozzles and to thus use the bypass air stream for pre-cooling the system or for the temperature-regulation during a pressure interruption, without there being leakage losses or a water drag-in into the system.

Flaps can be arranged in the rinsing chambers with which the apertures for the rinsing nozzles and the drawing-off can be closed such that by means of a suitable stream guidance through the fixing chamber, the solvent concentration in the surrounding area of the carrier web is quickly lowered in the inside of the fixing chamber. Thus, a partial over-fixing of the print image in the start-stop mode of the printer can be avoided.

Although in the drawings and in the previous description preferred embodiments have been illustrated and described in every detail, this is to be considered as being merely exemplary and as not restricting the invention. It is pointed out that only the preferred embodiments have been illustrated and described and all variations and modifications which are within the scope of the invention at present or in the future are protected.

We claim as our invention:

1. A device for fixing toner images on a carrier web, comprising:

a fixing chamber in which toner images present on the carrier web are charged with a solvent vapor;

respective gaps via which the carrier web is supplied to and carried away from the fixing chamber;

a rinsing chamber exterior to the fixing chamber and located before at least one of the gaps, one gap in the rinsing chamber solvent vapor exiting from the at least one gap being mixed with air and the mixture being drawn off;

at least a portion of the drawn-off mixture being fed to a condenser that condenses and separates at least one solvent; and air exiting the condenser being re-supplied to the rinsing chamber.

2. The device according to claim 1 wherein the air re-supplied to the rinsing chamber is supplied at least partially with a direction of flow that is directed from an opening for the carrier web into the rinsing chamber toward the gap.

3. The device according to claim 1 wherein the air re-supplied to the rinsing chamber is divided and the divided air streams are guided as symmetric counter streams.

4. The device according to claim 3 wherein a partial air stream entrains the solvent vapor exiting from the gap and another partial air stream entrains outdoor air entering via the carrier web opening.

5. The device according to claim 1 wherein the rinsing chamber is located after an exit gap in the fixing chamber as viewed in a transport direction of the carrier web.

6. The device according to claim 5 wherein the rinsing chamber has a sealing roller in an area of exit of the carrier web, said sealing roller contacting the carrier web.

7. The device according to claim 6 wherein the sealing roller is in contact with a sealing lip.

8. The device according to claim 6 wherein the sealing roller comprises a toner-repellent material on its surface.

9. The device according to claims 1 wherein air supplied to the rinsing chamber is directed at the toner images and dries them.

10. The device according to claim 1 wherein the solvent separated by the condenser is re-supplied to a solvent circuit.

11. The device according to claim 1 wherein a portion of dried air is fed back to the condenser and another portion is directly re-supplied to the rinsing chamber.

12. The device according to claim 1 wherein the solvent separated by the condenser is fed to a separator in which water is separated from the solvent.

13. The device according to claim 12 wherein a distiller is employed as the separator.

14. The device according to claim 1 wherein the condenser is arranged at one of outside the rinsing chamber and inside the rinsing chamber.

15. The device according to claim 1 wherein the carrier web is provided with toner images only on one side, said toner images being charged with solvent vapor only on one side.

16. The device according to claim 1 wherein the carrier web is provided with toner images on both sides, fixing devices with solvent vapor and for rinsing of the carrier web being arranged on both sides of the carrier web.

17. The device according to claim 1 wherein the carrier web is provided with toner images on both sides; and devices for fixing and rinsing being arranged such that first one side of the carrier web with toner images is fixed, and then subsequently another side with toner images is fixed.

18. A method for fixing toner images on a carrier web, comprising the steps of:

supplying the carrier web to and carrying it away from a fixing chamber via respective gaps;

in the fixing chamber charging the toner images present on the carrier web with a solvent vapor;

in front of at least one of the gaps arranging a rinsing chamber in which solvent vapor exiting from the gap is mixed with air and the mixture is drawn off;

feeding at least a portion of the drawn-off mixture to a condenser which condenses and separates solvents; and re-supplying air exiting the condenser to the rinsing chamber.

19. The method according to claim 18 wherein the air supplied to the rinsing chamber is at least partially supplied with a direction of flow that is directed from a carrier web opening in the rinsing chamber toward the gap.

20. The method according to claim 18 wherein the air which is re-supplied to the rinsing chamber is divided and streams of the divided air are guided as symmetric counter streams.

21. A device for fixing toner images on a carrier web, comprising:

a fixing chamber in which toner images present on the carrier web are charged with a solvent vapor;

respective gaps via which the carrier web is supplied to and carried away from the fixing chamber;

respective first and second rinsing chambers exterior to the fixing chamber and located adjacent the respective gaps, in the rinsing chamber solvent vapor exiting from the gaps being mixed with air and the mixture being drawn off;

at least a portion of the drawn-off mixture being fed to a condenser that condenses and separates at least one solvent; and air exiting the condenser being re-supplied to the first and second rinsing chambers.

22. A method for fixing toner images on a carrier web, comprising the steps of:

supplying the carrier web to and carrying it away from a fixing chamber via respective gaps;

in the fixing chamber charging the toner images present on the carrier web with a solvent vapor;

adjacent each of the gaps arranging a respective rinsing chamber in which solvent vapor exiting from the gap is mixed with air and the mixture is drawn off;

feeding at least a portion of the drawn-off mixture to a condenser which condenses and separates solvents; and re-supplying air exiting the condenser to the rinsing chambers.

* * * * *